US006056085A

United States Patent [19]

Cutter et al.

[11] Patent Number: 6,056,085

[45] Date of Patent: May 2, 2000

[54] ANCHORAGE METHODS AND APPARATUS

[75] Inventors: Weston L. Cutter, Mendota Heights, Minn.; Pat J. Novak, North Liberty, Iowa

[73] Assignee: Capital Safety Inc., Red Wing, Minn.

[21] Appl. No.: 09/177,410

[22] Filed: Oct. 23, 1998

[51] Int. Cl.[7] ..... A62B 37/00

[52] U.S. Cl. ..... 182/36

[58] Field of Search ..... 182/36, 3

[56] References Cited

U.S. PATENT DOCUMENTS

| | | | |
|---|---|---|---|
| 3,675,283 | 7/1972 | Gregorovic | 24/73 SA |
| 4,265,179 | 5/1981 | Tupper | 104/182 |
| 4,584,945 | 4/1986 | Tupper | 104/182 |
| 4,790,410 | 12/1988 | Sharp | 182/36 |
| 4,905,606 | 3/1990 | Tupper | 104/113 |
| 5,002,152 | 3/1991 | Lebow | 182/3 |
| 5,127,338 | 7/1992 | Flux | 105/151 |
| 5,279,385 | 1/1994 | Riches | 182/3 |
| 5,297,651 | 3/1994 | Vandelinde | 182/3 |
| 5,343,975 | 9/1994 | Riches | 182/3 |

*Primary Examiner*—Alvin Chin-Shue
*Attorney, Agent, or Firm*—Mau & Krull, P.A.

[57] ABSTRACT

An anchorage is interconnected between a support structure and a safety line. The anchorage accommodates passage of a slotted coupling device movably mounted on the safety line. The safety line may be secured to the anchorage without obtaining access to either end of the line.

18 Claims, 5 Drawing Sheets

ANCHORAGE METHODS AND APPARATUS

FIELD OF THE INVENTION

The present invention relates to methods and apparatus for anchoring an intermediate portion of a guide line relative to a support structure while accommodating passage of a slotted coupling device movably mounted on the line.

BACKGROUND OF THE INVENTION

Those skilled in the art recognize the need to anchor objects and/or people relative to a support structure. For example, when a building is being constructed, a worker is well advised to attach a safety line or fall arrest line between his body and a structurally sound portion of the building. One widely accepted fall arrest system uses intermittent brackets to support a horizontal line which supports individual worker safety lines and minimally interferes with the worker's movements. A slotted coupling device is connected to an individual safety line and movably mounted on the horizontal line. The device is designed to traverse the brackets without compromising the structural integrity of the connection between the worker and the support structure. Examples of such systems are disclosed in U.S. Pat. No. 5,343,975 to Riches et al., U.S. Pat. No. 5,279,385 to Riches et al., U.S. Pat. No. 5,224,427 to Riches et al., and U.S. Pat. No. 4,790,410 to Sharp et al.

The foregoing prior art patents disclose horizontal safety line systems which are advantageous in many respects. However, one shortcoming of such systems is that the safety line must be threaded through each of the anchorages or support brackets. As a result, if one of the brackets requires replacement, then an end of the safety line must be freed, pulled through any intervening brackets, and then threaded through the replacement bracket and back through the intervening brackets. Such a procedure is time consuming and increases the likelihood of undesirable wear and tear on other components of the system. Therefore, a need remains for an intermediate anchorage or bracket which is relatively simple to make and use, may be connected to an intermediate portion of a safety line, and does not compromise the structural integrity of the system.

SUMMARY OF THE INVENTION

The present invention provides an anchorage which may be connected to an intermediate portion of a safety line, and which accommodates passage of a slotted coupling device movably mounted on the safety line. The anchorage also provides superior energy absorbing characteristics relative to the prior art devices. In a preferred embodiment, opposing plates extend between a tubular support for the safety line and a bracket suitable for mounting to a support structure. The plates are interconnected in a manner which retains the safety Line in the tubular support and retains the plates relative to the bracket. Many features and/or advantages of the present invention may become more apparent from the detailed description which follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
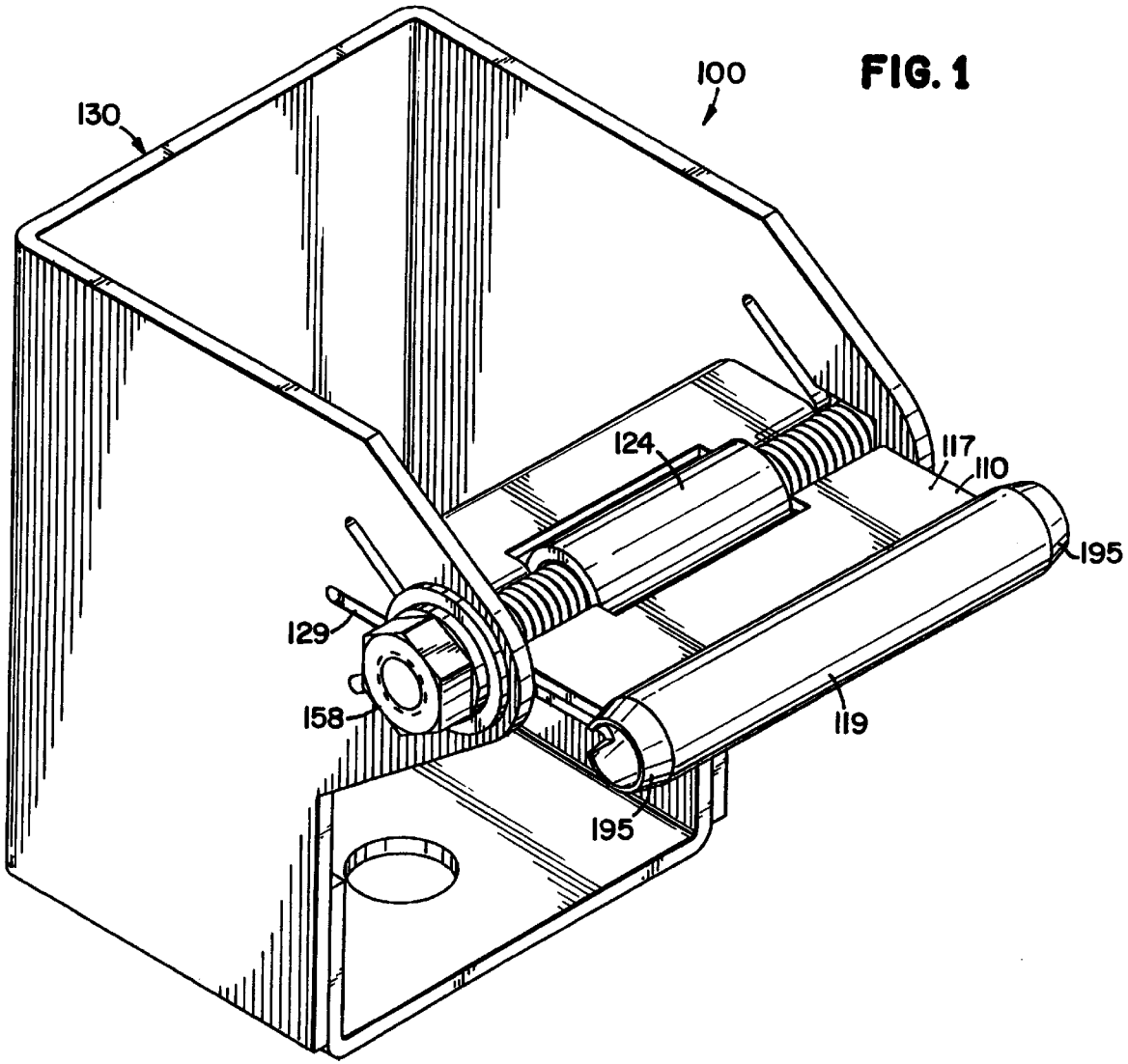
FIG. 1 is a perspective view of an anchorage constructed according to the principles of the present invention.
Figure 2:
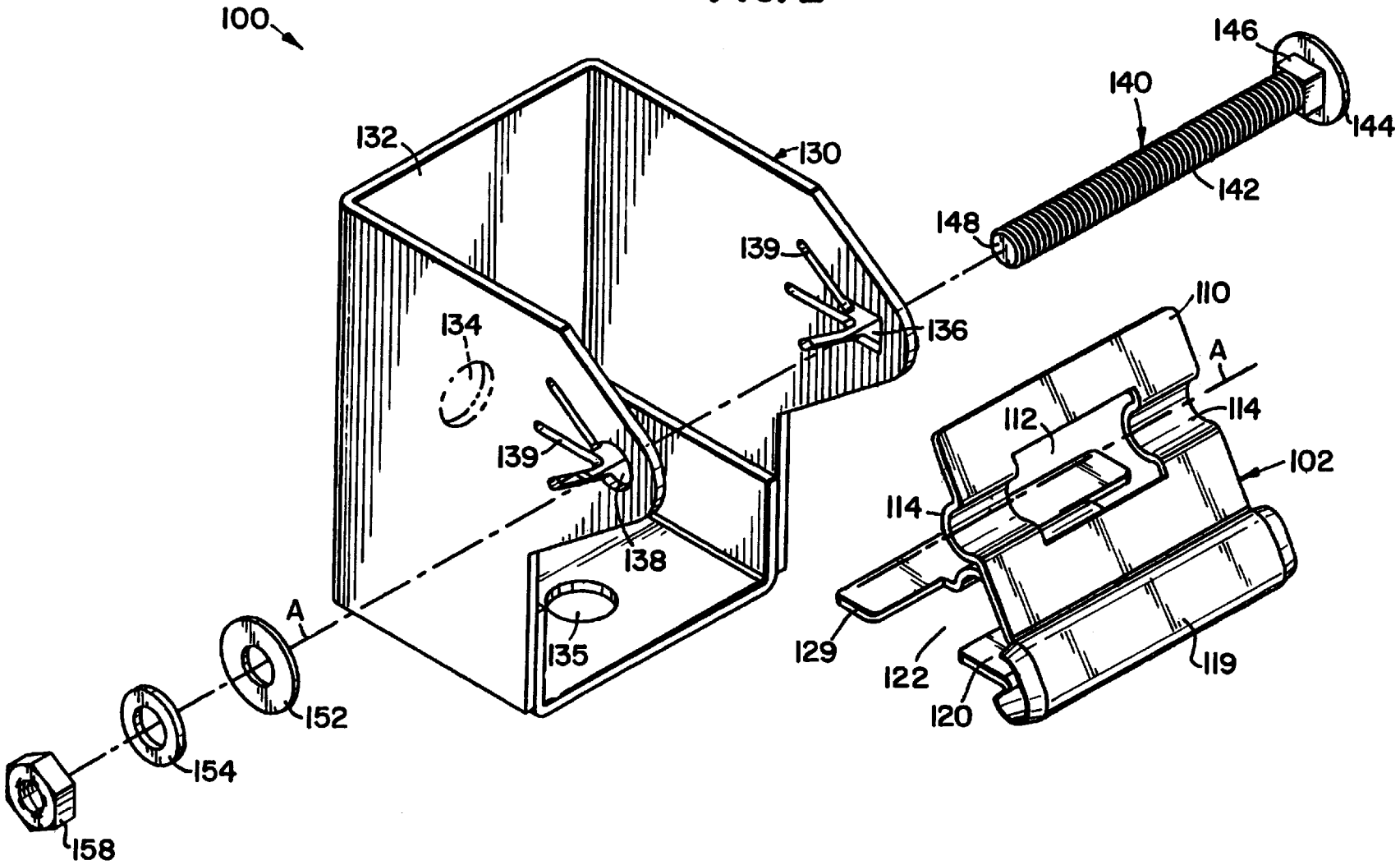
FIG. 2 is an exploded perspective view of the components of the anchorage shown in FIG. 1.
Figure 5:
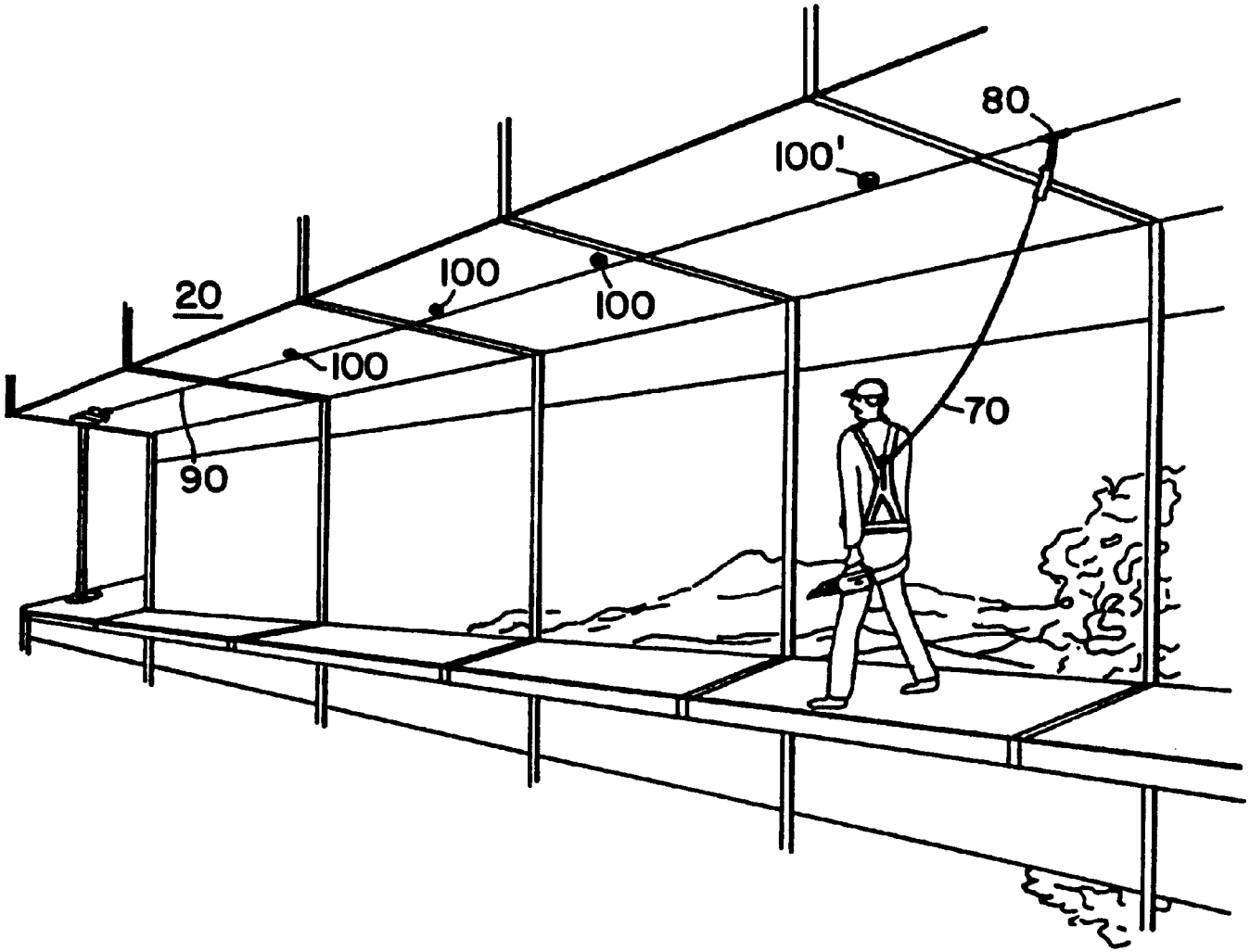
FIG. 5 is a perspective view of a horizontal safety line system including several units of the anchorage shown in FIG. 1.

A preferred embodiment anchor assembly constructed according to the principles of the present invention is designated as 100 in FIGS. 1–2 and 5. The assembly 100 generally includes a safety line support 102, a bracket 130, and a bolt 140 connected to the bracket 130 and the support 102. The assembly 100 is suitable for use as a component in horizontal safety line systems like those disclosed in U.S. Pat. No. 5,343,975 to Riches et al., U.S. Pat. No. 5,279,385 to Riches et al., U.S. Pat. No. 5,224,427 to Riches et al., and U.S. Pat. No. 4,790,410 to Sharp et al., all of which are incorporated herein by reference.

The support 102 may be described in terms of a first plate 110 and a second plate 120 which are integral portions of a single member. The support 102 is preferably made of steel and provided in the configuration shown in FIG. 2. A cylindrical tube 119 is defined at the integrally joined ends of the plates 110 and 120. The tube 119 is sized and configured to fit snugly over a safety line and to accommodate passage of a slotted coupling member. Opposite ends 195 of the tube 119 are tapered to facilitate alignment of the coupling member with the tube 119.

The lower plate 120 (as viewed in FIGS. 1–2) has a distal end opposite the cylinder 119. This opposite end of the plate 120 is provided with tabs 129 which extend in opposite directions from one another and parallel to the longitudinal axis of the tube 119 (and the safety line). When the support member 102 is configured as shown in FIG. 2, the tabs 129 may be maneuvered into any of the opposing pairs of slots 139 defined in the bracket 130, as will be further discussed below.

The upper plate 110 also has a distal end opposite the cylinder 119. This opposite end of the plate 110 is maneuvered into proximity to the other plate 120 (and its distal end) by rotating the plates 110 and 120 toward one another. This rotating step must overcome resistance to bending of the material defining the cylindrical tube 119 and effectively closes the tube 119 about the safety line. When the support member 102 is configured as shown in FIG. 1, the tabs 129 are effectively retained by the bracket 130 (even before insertion of the bolt 140).

An intermediate portion of the upper plate 110 has channel defining portions 114 disposed on opposite sides of an opening 112. The portions 114 have a semi-cylindrical profile centered about an axis designated as A in FIG. 2. An intermediate portion of the lower plate 120 has a notch 122 in each side to accommodate a respective portion 114 of the upper plate 110. The intermediate portion of the lower plate 120 also has a channel defining portion 124 which protrudes through the opening 112 in the upper plate 110. The portion 124 has a semi-cylindrical profile which is also centered about the axis A, and which is complementary to the profile of the portions 114 on the upper plate 110. In other words, when the plates 110 and 120 are disposed as shown in FIG. 1, the interwoven portions 114 and 124 cooperate to define a passage bounded by cylindrical sidewalls.

The bolt 140 has a shaft 142 which extends from a head 144 to a distal end 148. The portion of the shaft 142 nearest the head 144 has a square profile designated at 146 in FIG. 2. The remainder of the shaft 142 has a circular profile and is provided with helical threads. With the tabs 129 occupying the desired slots 139, the distal end 148 of the bolt 140 is inserted through a square hole 136 in a first sidewall of the bracket 130, then through the interwoven portions 114 and 124, and then through the round hole 138 in an opposite sidewall of the bracket 130. A flat washer 152 and a spring washer 154 are moved onto the distal end 148, followed by a threaded nut 158. Among other things, a lock nut may be substituted for the nut 158 and the spring washer 154.

During tightening of the nut 158, the bolt 140 is manipulated so that the squared portion 146 of the shaft 142 inserts into the square hole 136 in the sidewall of the bracket 130. When assembled as shown in FIG. 1, the support 102 may be described in terms of a neck portion 117 and a head portion 119 which are sized and configured to support a safety line while accommodating passage of a slotted coupling member along the safety line.

The aforementioned sidewalls of the bracket 130 extend parallel to one another and perpendicular to the axis A. The slots 139 in each sidewall intersect the axis A, and adjacent slots 139 define an angle of thirty degrees therebetween. Hence, if the orientation of the bracket 130 in FIG. 2 is considered upright, then the support 102 may be secured to the bracket 130 in such a manner that the neck portion 117 extends horizontally or thirty degrees in either direction from horizontal.

The bracket 130 has an end wall which extends perpendicular to the sidewalls and the middle slots 139, and a base wall which extends perpendicular to both the end wall and the sidewalls. A respective hole 134 or 135 extends through a central portion of each of these two walls to facilitate connection of the bracket 130 to a support structure (by means of a bolt, for example). The net effect of the alternative mounting holes 134 and 135 and the alternative slots 139 is that neck portion 117 of the support 102 may always be disposed at an angle within fifteen degrees of an optimal orientation regardless of installation constraints.

FIG. 5 shows a plurality of anchorages 100 mounted to an overhead (from the perspective of the depicted worker) portion of a support structure 20. The anchorages 100 support a horizontal safety line 90, and the worker's individual safety line 70 is connected to the horizontal safety line 90 by means of a slotted coupling member 80. As noted above, if the anchorage designated as 100' were damaged to the exclusion of the other anchorages 100, then the damaged anchorage 100' could simply be removed and replaced without disconnecting the line 90 from the other anchorages 100 and subsequently reconnecting the line 90 to the other anchorages 100.

Figure 3:
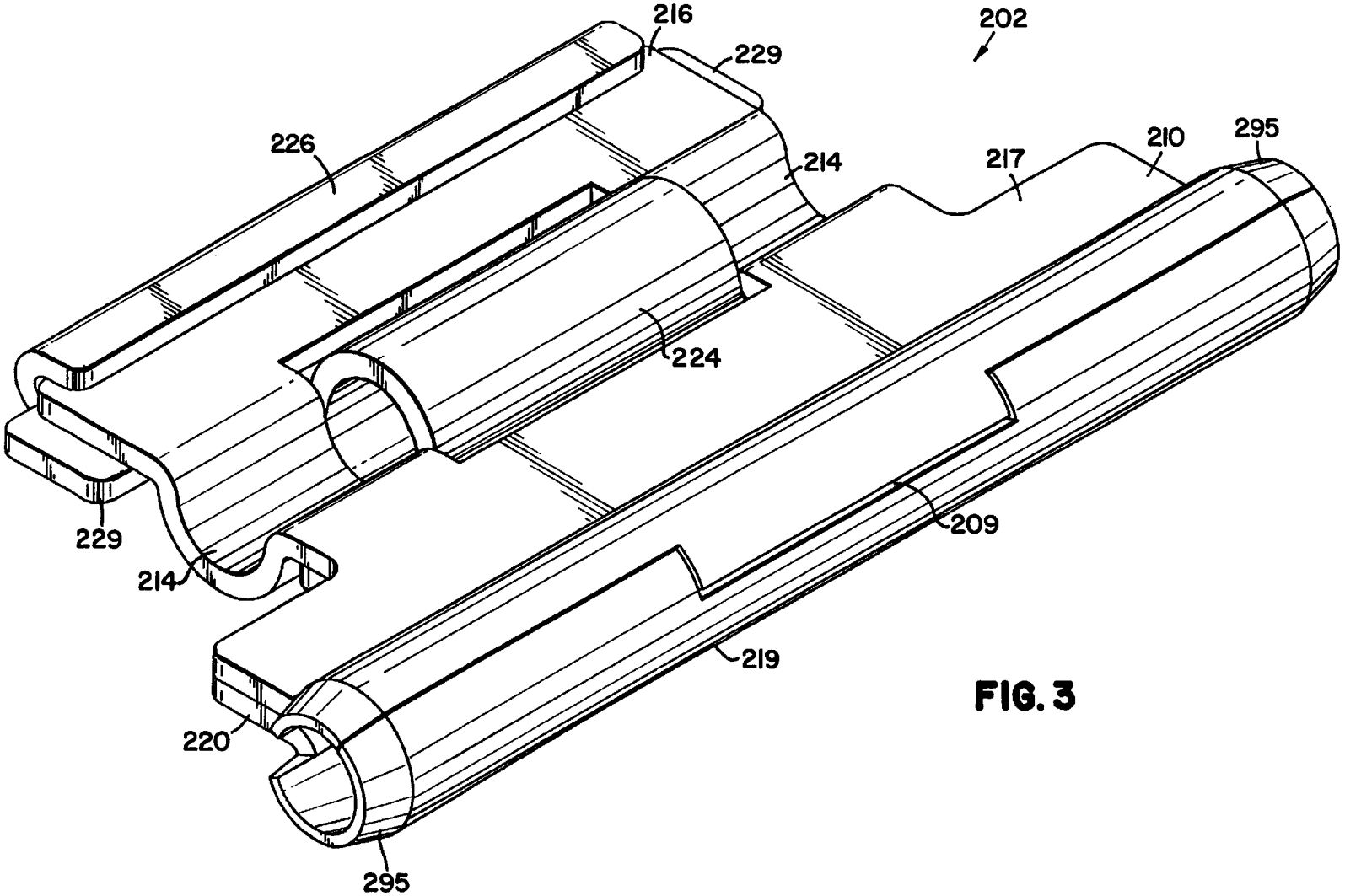
FIG. 3 is a perspective view of an alternative component suitable for use on the anchorage shown in FIG. 1.

The foregoing description is made with reference to only one, preferred embodiment of the present invention. Those skilled in the art will recognize various modifications may be made to the preferred embodiment 100 without departing from the scope of the present invention. For example, an alternative support portion of the present invention is designated as 202 in FIG. 3. The support 202 is suitable for use together with the bracket 130 and bolt 140 shown in and described with reference to FIGS. 1–2. However, this embodiment 202 did not test as well as the preferred embodiment support 102.

The support 202 includes first and second plates 210 and 220 having first ends which cooperate to define a cylindrical tube 219, and intermediate portions which cooperate to define a neck portion 217 extending between the tube 219 and the bracket 130. Contrary to the preferred embodiment support 102, the plates 210 and 220 are separate pieces (which cooperate to define a seam designated as 209 in FIG. 3). At an end of the support 202 opposite the seam 209, a distal end 226 of the lower plate 220 folds over a distal end 216 of the upper plate 210. Like on the preferred embodiment support 102, the ends 295 of the tube 219 are tapered to facilitate alignment of slotted coupling members relative thereto. Also, similar channel defining portions 214 and 224 and corresponding notches are provided on respective plates 210 and 220 to receive the bolt 140. As on the preferred embodiment support 102, tabs 229 extend in opposite directions from the lower plate 220 and insert into respective slots 139 in the bracket 130.

Figure 4:
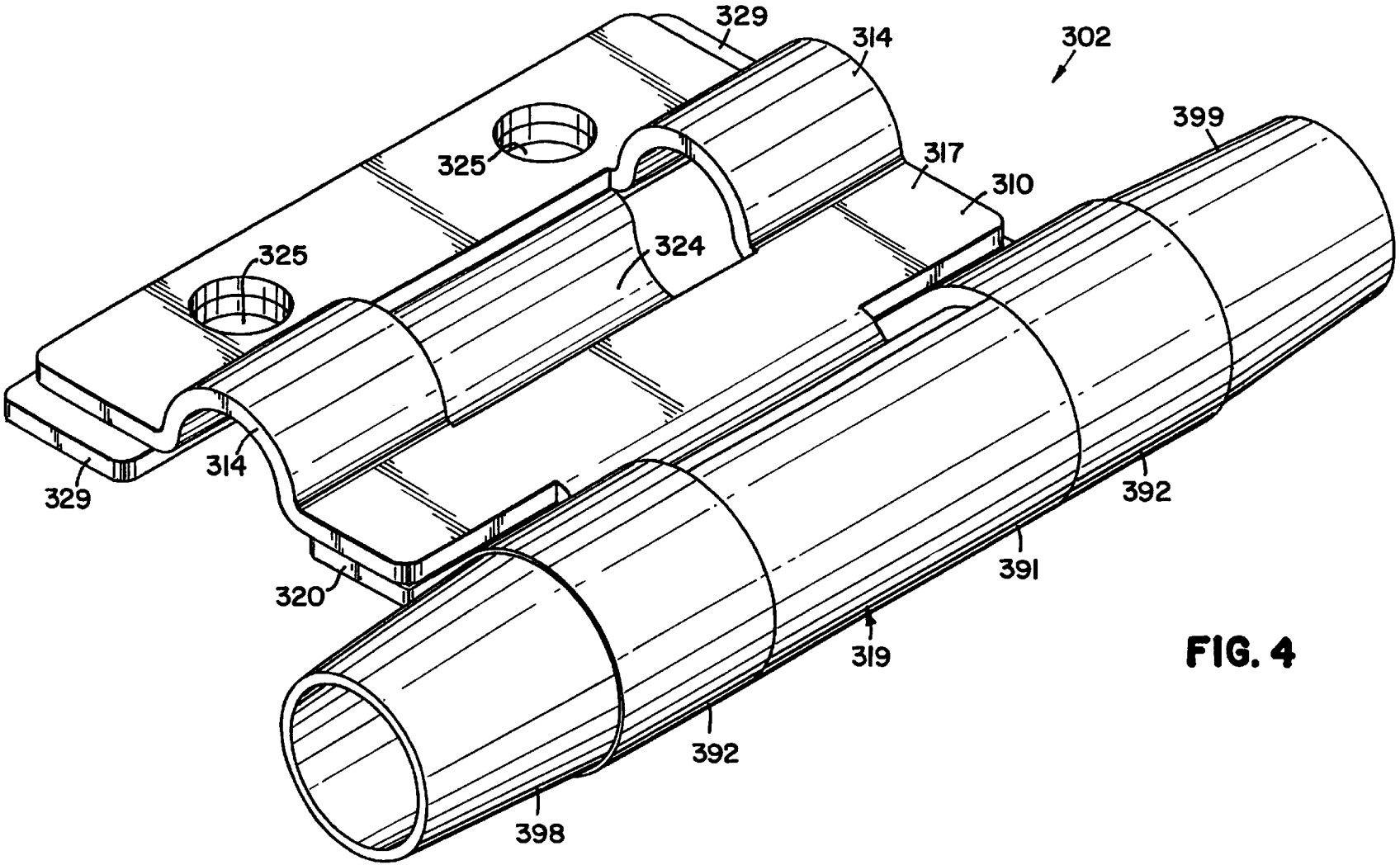
FIG. 4 is a perspective view of another alternative component suitable for use on the anchorage shown in FIG. 1.

Another alternative support portion is designated as 302 in FIG. 4. The support 302 is likewise suitable for use together with the bracket 130 and bolt 140 shown in and described with reference to FIGS. 1–2. However, this embodiment 202 also did not test as well as the preferred embodiment support 102.

The support 302 includes first and second plates 310 and 320 having first ends 391 and 392 which cooperate to define a cylindrical tube 319, and intermediate portions which cooperate to define a neck portion 317 extending between the tube 319 and the bracket 130. As on the support 202, the plates 310 and 320 are separate pieces. The first end 391 of the first plate 310 defines about three-fourths of a cylinder and protrudes through a central opening in the second plate 320. The first end of the second plate 320 has opposite portions 392 which define about three-fourths of cylinders and protrude through respective opposite side notches in the first plate 310. The interwoven cylindrical portions 391 and 392 align and cooperate to define the tube 319. Bifurcated halves 398 and 399 of a nylon bushing are disposed about the horizontal safety line and within the tube 319. The ends of the bushing are tapered to facilitate alignment of slotted coupling members relative thereto.

At an end of the support 302 opposite the tube 319, distal ends of the plates 310 and 320 overlap and are bolted together via aligned holes 325. As on the other supports 102 and 202, tabs 329 extend in opposite directions from the lower plate 320 and insert into respective slots 139 in the bracket 130. Also, channel defining portions 314 and 324 are provided on respective plates 310 and 320 to receive the bolt 140. The open areas in the intermediate portions of the plates 310 and 320 are not necessary on this embodiment 302, because the portions 314 and 324 are not intersected by a plane defined between the two plates 310 and 320.

Although the present invention has been described with reference to specific embodiments and particular applications, those skilled in the art will recognize other embodiments and/or applications. Moreover, although specifically designed for use relative to an intermediate portion of a horizontal safety line, the present invention is nonetheless suitable for use with a safety line having exposed ends. Also, as compared to prior art anchorages, and in particular, the bracket disclosed in U.S. Pat. No. 5,343,975 to Riches et al., the construction of the preferred embodiment anchorage 100 enables it to absorb approximately twice as much energy when subjected to forces associated with the arrest of a person's fall.

In view of the foregoing, a person skilled in the art may be inclined to make an intermediate bracket which is structurally comparable to the preferred embodiment anchorage 100 but cannot be secured to the intermediate portion of a safety line. In this regard, the present invention may be seen to provide an anchorage having at least one plate 110, 120 extending between a first end and a second end. The first end supports a tube 119 sized and configured to support a safety line inside the tube and to accommodate passage of a slotted coupling member outside the tube. The second end has tabs 129 which extend in opposite directions into slots 139 formed in opposing sidewalls of a bracket 130. A bolt 140 extends through holes in opposite sidewalls of the bracket 130 and through a channel on the at least one plate 110, 120. The resulting anchorage 100 is sized and configured to absorb energy in excess of known prior art devices.

A person skilled in the art may also be inclined to make an intermediate bracket which provides the versatility of the preferred embodiment anchorage 100 but cannot be secured to the intermediate portion of a safety line. In this regard, the present invention may be seen to provide an anchorage having at least one plate 110, 120 extending between a first end and a second end. The first end supports a tube 119 sized and configured to support a safety line inside the tube and to accommodate passage of a slotted coupling member outside the tube. The second end has tabs 129 which extend in opposite directions into any of several pairs of slots 139 formed in opposing sidewalls of a bracket 130. A bolt 140 extends through holes in opposite sidewalls of the bracket 130 and through a channel on the at least one plate 110, 120. The bracket 130 has an end wall which extends perpendicular to the sidewalls and the middle slots 139, and a base wall which extends perpendicular to both the end wall and the sidewalls. A respective hole 134 or 135 extends through a central portion of each of these two walls to facilitate connection of the bracket 130 to a support structure. The resulting anchorage 100 is adapted to accommodate a wider variety of installation scenarios than any known prior art device.

With the foregoing in mind, the present invention should be limited only to the extent of the following claims.

What is claimed is:

1. An anchorage device interconnected between a support structure and a safety line which supports a slotted coupling device, comprising:

opposing first and second plates having (a) first ends which cooperate to surround the safety line; (b) opposite, second ends; (c) flat intermediate portions, disposed adjacent the first ends and sized and configured to accommodate passage of the slotted coupling device; and (d) interwoven intermediate portions, disposed between the flat intermediate portions and the second ends; and a bolt extending through a passage defined by the interwoven intermediate portions.

2. The anchorage device of claim 1, further comprising a bracket having opposing sidewalls which extend perpendicular to the first and second plates, wherein the bolt also extends through aligned bolt holes in the opposing sidewalls.

3. The anchorage device of claim 2, wherein the sidewalls have slots formed therein, and at least one of the first and second plates has tabs which extend into respective slots to maintain the first and second plates in a fixed orientation relative to the bracket.

4. The anchorage of claim 3, wherein the sidewalls have multiple pairs of slots formed therein to alternatively support the first and second plates in a plurality of fixed orientations relative to the bracket.

5. The anchorage device of claim 4, wherein the bracket has a base wall extending perpendicular to the sidewalls, and an end wall extending perpendicular to both the base wall and the sidewalls, and a first mounting hole extends through the end wall to facilitate anchorage of the bracket in a first orientation relative to the support structure, and a second mounting hole extends through the base wall to facilitate anchorage of the bracket in a second orientation relative to the support structure.

6. The anchorage device of claim 1, wherein the first and second plates are integral portions of a single, unitary member.

7. The anchorage device of claim 6, wherein the first ends form a seamless tube about the safety line.

8. The anchorage device of claim 1, wherein before the bolt is inserted into the passage, the first and second plates are adjustable between an intermediate configuration, which facilitates connection to the safety line, and an operational configuration, which accommodates passage of the slotted coupling device.

9. The anchorage device of claim 1, wherein the second ends are interconnected by at least one fastener extending perpendicular to the bolt.

10. The anchorage device of claim 1, wherein a first one of the second ends is disposed between opposing segments on a second one of the second ends.

11. An anchorage device interconnected between a support structure and a safety line which supports a slotted coupling device, comprising:

at least one plate having (a) a first end which surrounds the safety line; (b) an opposite, second end; (c) a flat intermediate portion, disposed adjacent the first end and sized and configured to accommodate passage of the slotted coupling device; and (d) a second intermediate portion, disposed between the flat intermediate portion and the second end;

a bracket anchored to the support structure and having opposing sidewalls with bolt holes formed therein, wherein the second intermediate portion is disposed between the sidewalls and aligned relative to the bolt holes, the bracket having a base wall extending perpendicular to the sidewalls, and an end wall extending perpendicular to both the base wall and the sidewalls, and a first mounting hole extending through the end wall, and a second mounting hole extending through the base wall, and a fastener being inserted through at least one said mounting hole and into the support structure; and a bolt extending through the bolt holes in the bracket and into engagement with the second intermediate portion.

12. The anchorage device of claim 11, wherein a first one of the bolt holes is square, and a second one of the bolt holes is circular.

13. An anchorage device interconnected between a support structure and a safety line which supports a slotted coupling device, comprising:

at least one plate having (a) a first end which surrounds the safety line; (b) an opposite, second end; (c) a flat intermediate portion, disposed adjacent the first end and sized and configured to accommodate passage of the slotted coupling device; and (d) tabs projecting from opposite sides of the at least one plate, proximate the second end and parallel to the safety line;

a bracket anchored to the support structure and having opposing sidewalls with slots and bolt holes formed therein, wherein the second end is disposed between the sidewalls, and the tabs extend into respective slots to maintain the at least one plate in a fixed orientation relative to the bracket; and a bolt extending through the bolt holes in the bracket.

14. The anchorage device of claim 13, wherein the sidewalls have multiple pairs of slots formed therein to alternatively support the at least one plate in a plurality of fixed orientations relative to the bracket.

15. The anchorage device of claim 14, wherein the bracket has a base wall extending perpendicular to the sidewalls, and an end wall extending perpendicular to both the base wall and the sidewalls, and a first mounting hole extends through the end wall to facilitate anchorage of the bracket in a first orientation relative to the support structure, and a second mounting hole extends through the base wall to facilitate anchorage of the bracket in a second orientation relative to the support structure.

16. The anchorage of claim 15, wherein the slots in each of the sidewalls radiate from a common point, and adjacent slots define an angle of thirty degrees therebetween.

17. The anchorage of claim 14, wherein the slots extend radially away from respective bolt holes.

18. The anchorage of claim 14, wherein the slots in each of the sidewalls radiate from a common point, and adjacent slots define an angle of thirty degrees therebetween.

* * * * *